United States Patent [19]

Günther

[11] Patent Number: 4,503,695

[45] Date of Patent: Mar. 12, 1985

[54] APPARATUS FOR BENDING LAYING TUBES

[75] Inventor: Karl-Heinz Günther, Düsseldorf, Fed. Rep. of Germany

[73] Assignee: Kocks Technik GmbH & Co., Hilden, Fed. Rep. of Germany

[21] Appl. No.: 517,229

[22] Filed: Jul. 25, 1983

[30] Foreign Application Priority Data

Aug. 4, 1982 [DE] Fed. Rep. of Germany ..... 3229051

[51] Int. Cl.[3] ..... B21D 11/06; B21F 3/04; B21F 3/10

[52] U.S. Cl. ..... 72/133; 72/139; 72/142; 72/305

[58] Field of Search ..... 72/133, 138, 139, 142, 72/149, 152, 305, 369; 140/124

[56] References Cited

U.S. PATENT DOCUMENTS

| | | | |
|---|---|---|---|
| 265,106 | 9/1882 | Lee | 72/139 |
| 2,525,093 | 10/1950 | Cahenzli | 72/142 |
| 3,739,615 | 6/1973 | Tressel | 72/142 X |
| 4,048,826 | 9/1977 | Lechner et al. | 72/142 X |
| 4,112,727 | 9/1978 | Brown | 72/142 |
| 4,391,115 | 7/1983 | Slattery et al. | 72/305 X |

FOREIGN PATENT DOCUMENTS

| | | | |
|---|---|---|---|
| 75818 | 6/1980 | Japan | 72/142 |

*Primary Examiner*—E. Michael Combs

*Attorney, Agent, or Firm*—Buell, Ziesenheim, Beck & Alstadt

[57] ABSTRACT

The invention concerns an arrangement for the bending of laying tubes for wire-winding layering apparatuses, in which the molding body that determines the form of the laying tube runs essentially horizontally and is rotatably supported, such that a better manipulation of the highly heated laying tube is achieved during bending. The molding body also consists of two drums, one inserted into the other, the outer one of which has a lateral edge that matches the laying tube form desired and the two drums have a generated surface that matches the laying tube form desired. Together, they serve as the stop surfaces for the bending process. In this manner, the bending of the laying tubes is considerably simplified and a precise laying tube form is achieved.

10 Claims, 3 Drawing Figures

APPARATUS FOR BENDING LAYING TUBES

This invention relates to apparatus for bending laying tubes and more particularly to an apparatus for bending laying tubes for the placement of thin elongate articles such as wire in looped windings.

Layering apparatuses for the placement of thin, elongated goods, especially wire hot from the rolls, in looped windings are known as Edenborn reels and have long been used, especially in the cooling intervals for hot-rolled wire. It is possible with such layering apparatuses to brake the high axial speed of the goods down toward zero and lay the goods in coils.

In such layering apparatuses the wire is guided by laying tubes, which must be bent spatially in a quite specific manner in order to avoid perturbations; reference is made to the DE-OS 30 02 026 for this. It is essential here that the shape of the laying tube defined there be effected as precisely as possible in order to avoid unnecessary wear phenomena in the laying tube, damage to the goods, and disturbances in the operation. Since such laying tubes consist of high-grade materials with regard to wear resistance and the shape that is to be achieved requires a three-dimensional bending operation, a bending arrangement on which the laying tube can be bent precisely in the hot state is required for producing such laying tubes.

The invention concerns such an arrangement for bending laying tubes for wire-winding layering apparatuses, with a molding body that determines the shape of the laying tube and a holder for the horizontal clamping of one of the two laying tube end sections on the edge zone of one face of the molding body.

In a familiar arrangement of this type (DE-OS 30 02 026) the molding body is conical with a vertical longitudinal axis and it has in the edge zone of the lower face a holder into which an end section of the laying tube can be inserted horizontally and clamped. The conical surface of the stationary molding body is provided with a number of positioning pins that together form a predetermined curve. The heated laying tube is pressed against these positioning pins and the stationary molding body after its end section has been clamped and is thus bent into the desired form.

This familiar bending apparatus has the disadvantage that it is unwieldy because the laying tube must be bent out of its initially horizontal position such that its free end section is finally vertical, while the other end section fastened in the holder still runs horizontally. This bending up by hand proved to be difficult at a laying tube temperature of ca. 1000° C. Furthermore, the desired shape of the laying tube cannot be attained as precisely with the familiar arrangement as would be desirable in the region of the free, essentially vertical laying tube end section.

The invention proposes an apparatus for bending laying tubes for wire-winding layering apparatuses that simplifies the bending process and facilitates a more precise shaping. This problem is resolved according to the invention in that the molding body consists of two horizontal, rotatably supported cylindrical drums that are shoved into each other concentrically with an identical slight radial wall spacing and are bound solidly to each other, and they have a cross sectional surface that deviates from a circle, in which the outer drum has a lateral edge cut to match the shape of the laying tube.

As a result, the horizontal position of the laying tube blank, which it assumes as it comes from the heating furnace, not only persists as it is being inserted into the holder of the apparatus, but this essentially horizontal position is also maintained to a great extent during the actual bending process. In addition, the free longitudinal section of the laying tube needs to be moved only in a horizontal plane during the bending process, because, instead of the laying tube, the molding body, which is also horizontal, can be rotated, which can be effected by hand or with a motor. This considerably facilitates the operation and also results in very precisely bent tubes. The rotary movement of the molding body and the guidance and holding of the free longitudinal section of the tube together effect a winding action in which the laying tube is wound on the molding body and thus acquires the prescribed shape.

The two drums, one inserted concentrically into the other, form in a relatively simple manner a molding body with precisely shaped contact surfaces that run all the way through and impart a precise shape to the laying tube without kinks. The outer surface of the inner drum and the lateral edge of the outer drum, which is cut to match the form of the laying tube, together form a type of channel into which the laying tube is wound as the molding body rotates. The end section of the laying tube that is installed on the inlet side in the wire-winding layering apparatus during operation is expediently clamped horizontally in the holder here. After the bending process, when the laying tube is brought into the operating position, it consequently possesses a flawlessly shaped entrance section, which was not always assured in the familiar arrangement. The lateral edge of the outer drum begins in the region of the holder for clamping the one end section of the laying tube. The fact that the two cylindrical drums that are fastened solidly together are not actually cylindrical, but have a cross-sectional surface that deviates from a circle, results from the laying tube curve desired. The form of the lateral edge of the outer drum is also determined by the laying tube curve desired. The manner in which this laying tube curve is designed and the form that the generated surfaces of the two drums and the lateral edge of the outer drum consequently must have is known from the DE-OS 30 02 026 and thus is not the object of the present invention.

In a preferred embodiment of the invention the holder for clamping the end section of the laying tube takes up the latter parallel to the axis of rotation of the drum. It is recommended here that a horizontally running cleat-like slide-in guide for the laying tube be provided on the generated surface of the inner drum in the region of the holder, parallel to the axis of rotation of the molding body. The laying tube, which comes from the heating furnace in the horizontal position, can then be placed in the slide-in guide parallel to the axis of rotation of the drum and thus also horizontal, without difficulty or changes in position, and can be slid inside this slide-in guide directly into the holder for clamping one of the two end sections of the laying tube and stopped there. There is no troublesome threading into the holder.

It is also advisable for the horizontal rotation axis of the molding body to extend through its spatial center of gravity. As a result, the molding body does not unexpectedly rotate in an undesirable manner during bending or during other times, a situation that could arise if the horizontal axis of rotation of the molding body were arranged in a different manner and then torques arise as a result of the equilibrium unevenly distributed with respect to the axis of rotation and induce an unexpected and undesired rotational movement of the molding body. Consequently, but also for a better conduct of the bending process, it is expedient if the molding body can be stopped in all rotational positions, which can also be achieved with an appropriate drive arrangement. However, the latter is in turn substantially relieved of load if the horizontal axis of rotation of the molding body extends through its spatial center of gravity.

It has proved advantageous if clamping units for holding the laying tube on the lateral edge are located along the shaping lateral edge of the outer drum. An unexpected sideslip of the laying tube is hereby avoided during bending by the lateral edge of the outer drum and thus the shaping surfaces. It is recommendable to fasten the clamping units on the generated surface of the outer drum. They do not perturb the bending process there and facilitate a flawless placement of the laying tube against the lateral edge and the generated surface of the inner drum.

In the foregoing general description I have set out certain objects, purposes and advantages of this invention. Other objects, purposes and advantages of this invention will be apparent from a consideration of the following description and the accompanying drawings in which.

Figure 1:
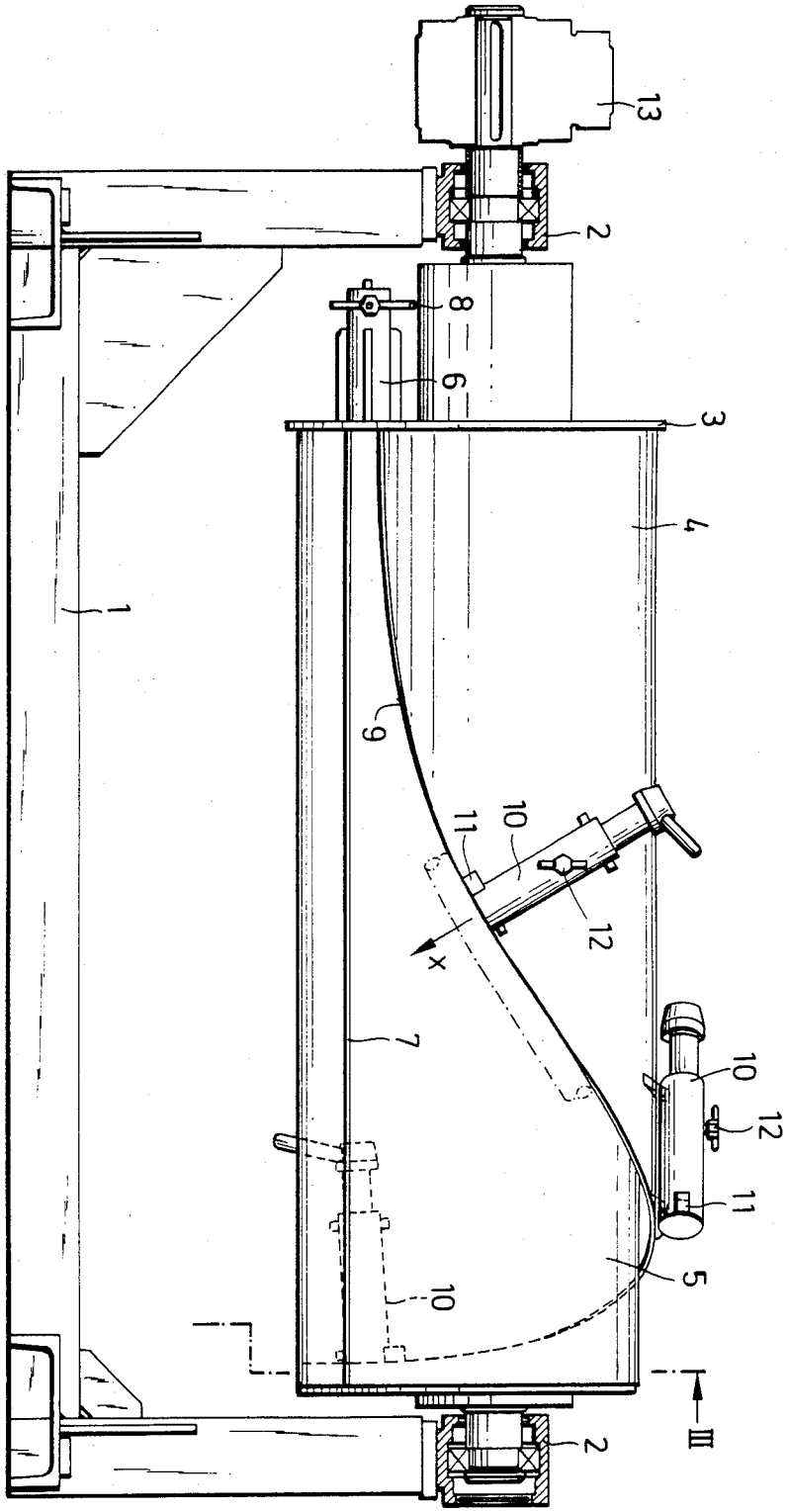
FIG. 1 shows the bending arrangement in side view, in partial section.

In FIG. 1 an essentially U-shaped stand of rolled sections of a bending arrangement for laying tubes is designated by 1. The two legs of the U-shaped stand 1 carry bearings 2, in which a molding body 3 is rotatably supported and extends in the horizontal direction.

The molding body 3 consists of two cylindrical drums 4 and 5, one of which is inserted concentrically inside the other and they are solidly fastened together and have a holder 6 for the horizontal clamping of one of the two end sections of the laying tube on one of their faces in the edge zone. A horizontally running cleat-like slide-in guide 7 is provided on the generated surface of the inner drum 5 in the region of the holder 6, parallel to the axis of rotation of the drum. The laying tube (not shown in the drawing) is placed on the slide-in guide 7 and inserted into the holder 6 in the axial direction. By turning a clamping spindle 8, the end section of the laying tube can be clamped in the holder 6 or loosened.

Beginning at the holder 6, the outer drum 4 has a lateral edge 9 that is designed to match the laying tube form desired. Clamping units 10 that are distributed on the length of the lateral edge 9 serve to hold the laying tube solidly pressed against the lateral edge 9 after bending, in which case they grip the laying tube in a hook-like manner with their fingers 11, which can be swung in the direction of the arrow x and to the generated surface of the drum 5. The finger 11 can be stopped with a setscrew 12 both in the clamping position during the clamping of the laying tube and also in the resting position shown in FIG. 1.

Figure 2:
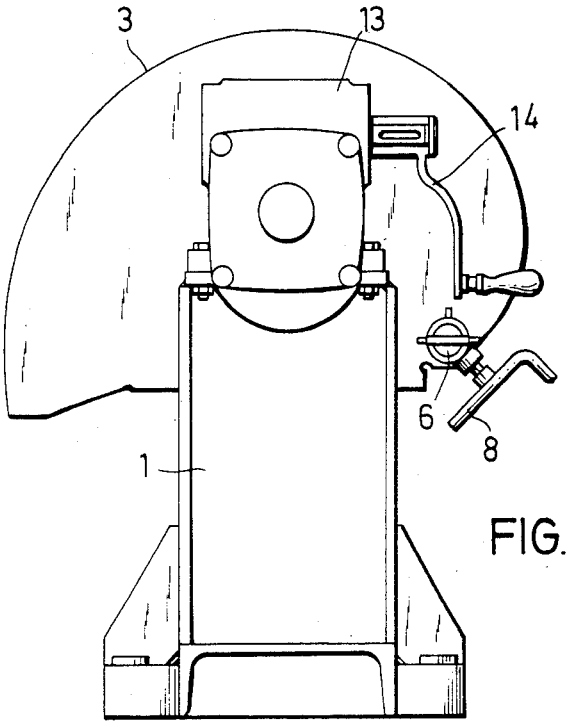
FIG. 2 shows the bending arrangement, viewed from the drive side.

It is clearly evident in FIG. 2 that the two drums 4 and 5 and thus the molding body 3 are not cylinders, but have a cross sectional surface that deviates from a circle. The form of this cross-sectional surface matches the desired curvature of the laying tube. The drive for the rotational movement of the molding body 3 is also evident in FIG. 2. The drive consists of a worm drive 13, which is actuated with the aid of a hand lever 14. The hand lever 14 can of course also be replaced by a suitable drive motor.

Figure 3:
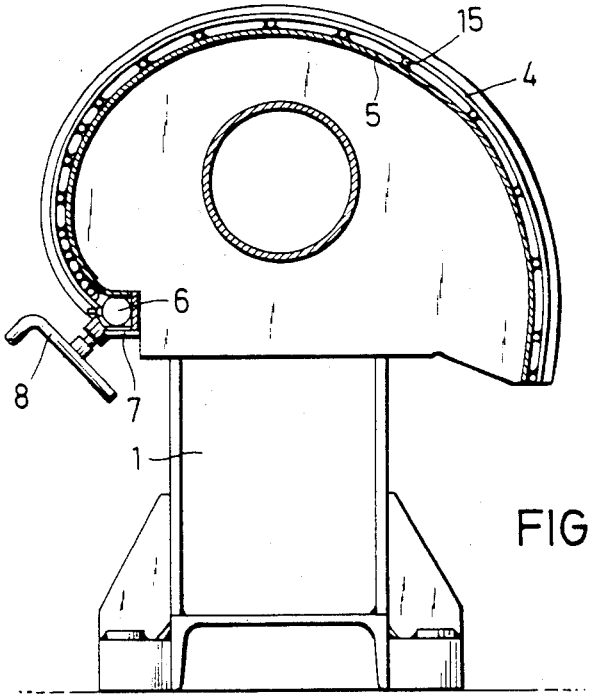
FIG. 3 shows a section along the line III—III of FIG. 1.

It is evident in FIG. 3 that the walls of the two drums 4 and 5 are arranged with a radial spacing from each other and that range spacers 15 hold the two walls of the drums 4 and 5 at an identical radial spacing. As in FIG. 2, the clamping units 10 are also omitted in FIG. 3 for simplification of the drawing.

The operation of the apparatus is believed to be obvious from the specification and drawings. A layering tube to be bent is fed from a furnace with the lead end sliding on slide in guide 7 until the lead end enters the holder 6, parallel to the axis of rotation of the forming drum. After the end enters holder 6, the clamp spindle 8 is tightened to hold the end in the holder 6. The drum combination 4, 5 is rotated in a clockwise direction, viewing FIG. 2 with the free end of the tube held at its original level mechanically (not shown) or by hand while the drum is rotated causing the tube to press against the lateral edge 9 and to follow its curvature. As the tube is bent along edge 9, the clamp units are pushed out and rotated to bring finger 11 on the outside of the tube which is pressed against edge 9. Finger 11 is drawn tight against the outside edge of the tube and clamped in place to hold the tube while cooling and rotation of the drum is continued until the entire laying tube is bent along the edge 9.

In the foregoing specification I have set out certain preferred practices and embodiments of this invention, however it will be understood that this invention may be otherwise embodied within the scope of the following claims.

I claim:

1. An apparatus for bending a laying tube for wire winding layering apparatus comprising a frame, a molding body for determining the shape of a laying tube, said body being made up of two non-circular concentric drums fixed together to form a unitary member, one inside and smaller than the other on a common horizontal axis, the outer drum having a lateral edge cut to match the lengthwise curvature of the laying tube extending lengthwise and around the drum and holding means at one end of the molding body for clamping an end section of the laying tube to said molding body, to engage and hold the laying tube on a line parallel to the axis of rotation of said molding body and means for rotating said molding body to move the lateral edge of the outer drum through the line of the laying tube to bend the same along the lateral edge.

2. Apparatus according to claim 1, wherein a cleat-like slide-in guide for the laying tube, extends horizontally and runs parallel to the axis of rotation of the molding body, on the generated surface of the inner drum in the region of the holding means.

3. Apparatus according to claim 1 wherein the horizontal axis of rotation of the molding body extends through its spatial center of gravity.

4. Apparatus according to claim 2 wherein the horizontal axis of rotation of the molding body extends through its spatial center of gravity.

5. Apparatus according to claim 1 wherein clamping units for holding the laying tube on the lateral edge are arranged along the shaping lateral edge of the outer drum.

6. Apparatus according to claim 2 wherein clamping units for holding the laying tube on the lateral edge are arranged along the shaping lateral edge of the outer drum.

7. Apparatus according to claim 3 wherein clamping units for holding the laying tube on the lateral edge are arranged along the shaping lateral edge of the outer drum.

8. Apparatus according to claim 5, wherein the clamping units are fastened on the generated surface of the outer drum.

9. Apparatus according to claim 6, wherein the clamping units are fastened on the generated surface of the outer drum.

10. Apparatus according to claim 7 wherein the clamping units are fastened on the generated surface of the outer drum.

* * * * *